US006167989B1

(12) United States Patent
Jung

(10) Patent No.: US 6,167,989 B1
(45) Date of Patent: Jan. 2, 2001

(54) LADDER SAFETY DEVICE

(76) Inventor: Koock Elan Jung, 564 Lockhart Mt Rd., Lake George, NY (US) 12845

( * ) Notice: Under 35 U.S.C. 154(b), the term of this patent shall be extended for 0 days.

(21) Appl. No.: 09/356,392

(22) Filed: Jul. 16, 1999

(51) Int. Cl.[7] ..... E06C 7/00
(52) U.S. Cl. ..... 182/172; 182/107; 182/214
(58) Field of Search ..... 182/172, 107, 182/108, 214

(56) References Cited

U.S. PATENT DOCUMENTS

| | | | | |
|---|---|---|---|---|
| 2,149,781 | * | 3/1939 | Leizer | 182/172 |
| 2,327,317 | * | 8/1943 | Randall | 182/214 |
| 5,113,973 | * | 5/1992 | Southern | 182/214 |
| 5,423,397 | * | 6/1995 | Boughner | 182/172 |

FOREIGN PATENT DOCUMENTS

| | | | | |
|---|---|---|---|---|
| 1137049 | * | 7/1982 | (CA) . | |
| 669518 | * | 12/1938 | (DE) | 182/72 |
| 3514734 | * | 11/1985 | (DE) | 182/107 |
| 81404 | * | 6/1983 | (EP) | 182/214 |
| 582592 | * | 12/1924 | (FR) | 182/107 |
| 2529611 | * | 1/1984 | (FR) | 182/172 |
| 2182086 | * | 5/1987 | (GB) | 182/214 |

* cited by examiner

*Primary Examiner*—Alvin Chin-Shue

(57) ABSTRACT

A safety device for a ladder, as embodied by the invention, is applied to a ladder that comprises side rails and a plurality of rungs interconnecting the side rails. The safety device comprises a plurality of side safety supports that are stored in their stored position in one rung of the plurality of rungs. The side safety supports are extendible from the one rung to a stabilizing extended position in which the side safety stabilizers are in contact with a supporting surface. Thus, the ladder safety device provides lateral stabilizing support for the ladder.

18 Claims, 7 Drawing Sheets

LADDER SAFETY DEVICE

BACKGROUND OF THE INVENTION

The invention relates to ladder safety device. In particular, the ladder safety device provides lateral skidding and lateral stabilizing support for a ladder. Further, the ladder safety device prevents backward skidding and provides backward stabilizing of a ladder.

There are two typical styles of ladders presently in use, the two-legged extension ladder and the step ladder. The extension ladder generally comprises two or more sections, which are coupled to one another. These sections permit one section to slide vertically relative to the other section. This style of ladder typically has its base, or lower end, resting on a supporting base surface, for example, a ground surface, and its upper end leaning against a stationary object, such as but not limited to a wall or roof eaves.

A step ladder generally has four legs, two front legs being arranged in a front leg frame supporting steps or rungs and two back legs. The back legs are joined to the front legs as a frame that is hinged, usually to a top step, to form an "A" shaped frame. A step ladder having four spaced-apart feet need not be leaned against a wall and is generally free-standing.

Extreme care should be exercised when positioning an extension ladder so that a person mounting the ladder does not create an undesirable and potentially harmful force vector. The vector force would tend to cause the feet of the extension ladder to slide backwardly, for example away from the wall. The upper end of the extension ladder may slide down the wall. This sliding can usually be prevented by properly setting the angle that the extension ladder is tilted. Thus, a major force vector caused by the load is primarily directly downward.

An extension ladder is also subject to lateral tipping, especially when the user is stretching out to a side more than he or she should stretch, for example to perform work. That is, rather than getting off the extension ladder and moving the ladder, users often lean laterally outward from the side of the extension ladder. This leaning can cause unbalancing of the ladder to the point where the extension ladder may tip over sideways. This problem is compounded further when the extension ladder's feet are not resting on a planar, horizontal base surface. Where the base surface is uneven or soft, there is a tendency for an extension ladder to lean or shift to one side, thus making it easier to tip when the climber leans to that one side.

Several devices are known in the art for attempting to stabilize an extension ladder. Some of these devices are attached to sides of the extension ladder, either permanently or as a removable attachment. These attached stabilizing devices extend from sides of the ladder and are generally connected to the extension ladder by mechanical connectors. These connectors are often the weakest points in the extension ladder and the stabilizing device. These attached stabilizing devices make a ladder heavier, difficult to carry, and difficult to store, since they add mass, volume, and weight to the ladder.

Further, several devices are known to attach to the leg bottoms of an extension ladder for anchoring the extension ladder to the ground. These devices stabilize the ladder for movement away from the stationary object, however they do not provide lateral stability to the extension ladder.

Therefore, a stabilizing or safety device for an extension ladder that provides lateral stabilizing support is needed.

Further, a ladder safety device that is integrally attached to the extension ladder is needed. Furthermore, a stabilizing or safety device for an extension ladder that provides for lateral stability and support on an uneven base is needed.

SUMMARY OF THE INVENTION

A safety device for a ladder, as embodied by the invention, is applied to a ladder that comprises side rails and a plurality of rungs interconnecting the side rails. The safety device comprises a joint and a plurality of side safety supports that are stored in their stored position in one rung of the plurality of rungs. The side safety supports are extendible from the one rung to a stabilizing extended position in which the side safety stabilizers are in contact with a supporting surface. Thus, the ladder safety device provides lateral stabilizing support for the ladder. Further, the ladder stabilizing device prevents backward skidding and provides backward stabilizing for the ladder.

Further, each side safety stabilizer of the plurality of side safety stabilizers comprises a plurality of sections. The plurality of sections is in telescoping relationship with each other. The plurality of side safety stabilizers further comprises a retainer to retain each side safety stabilizer in connection with the one rung. The retainer comprising a ball and socket assembly, which comprises a ball on one of the one rung and side safety stabilizer and a socket on the other of the one rung and side safety stabilizer. The safety stabilizer may be extended from the one rung until the ball engages the socket to stop the extension of the side safety stabilizer from the one rung. The side safety stabilizer comprises a plurality of telescoping sections.

Locking mechanisms are disposed between adjacent sections of the plurality of sections. In one aspect of the invention, the locking mechanism comprises a bayonet locking mechanism between adjacent sections, the bayonet locking mechanism comprising at least one channel and at least one slot on one of the adjacent sections, and at least one locking lug on the other of the adjacent sections. The at least one channel and the at least one slot are generally disposed orthogonal to each other, and the at least one locking lug enters the at least one slot in a first direction and then enters the at least one slot in a second direction that is generally orthogonal to the first direction to lock the adjacent sections with each other.

In another aspect of the invention, the locking mechanisms between adjacent sections of the plurality of sections comprise screw threads and locking connectors on adjacent sections of the plurality of sections.

In another aspect of the invention, the locking mechanisms between adjacent sections of the plurality of sections comprise spring biased locking detents and cooperating recesses on adjacent sections of the plurality of sections.

In yet another aspect of the invention, the locking mechanisms between adjacent sections of the plurality of sections comprise an expandable outer sleeve on one adjacent section and internal actuating device on the other adjacent section, the internal actuating device biasing the sleeve outwardly into an expanded position in which the sleeve is in close frictional engagement with the one adjacent section to lock the adjacent sections with each other.

Further, another aspect of the invention comprises spring-biased detent locking device for locking sections of the stabilizing, side safety support to each other in their extended position.

Further, a still aspect of the invention comprises spring-biased detent locking device for locking the stabilizing, side safety support in its extended position from the rung.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1:
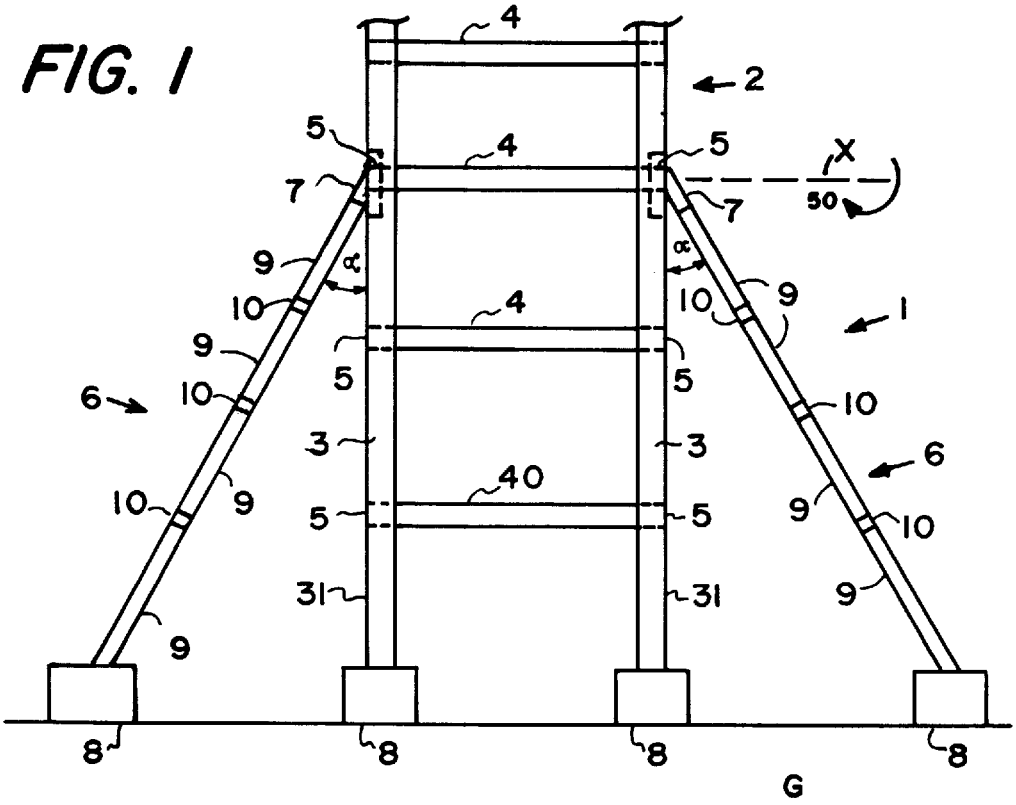
FIG. 1 is a front schematic view of a ladder safety device including stabilizing, safety device, as embodied by the invention, for an extension ladder.

A ladder safety device 1 for a ladder 2 comprises a plurality of stabilizing, side safety supports 6 that extend from at least one rung 4 of a ladder 2. The ladder 2 comprises, but is not limited to, an extension ladder. The incorporation of the stabilizing, safety device 6 in a rung 4 of a ladder 2 provides for at least one of, and typically a plurality of, enhanced stability, ease of storage and movement of the ladder, enhanced structure integrity, and ease of handling, carrying, and storage. Further, the ladder safety device 1 prevents backward skidding and provides backward stabilizing of a ladder 2 away from the stationary object against which one desires to climb. For example, the stationary object is a vertical wall.

The ladder safety device 1 and the stabilizing, side safety supports 6 will now be described with reference to the figures. The ladder safety device 1 is integrally connected to a ladder 2 so as to present a one-piece, non-removably connected assembly with a ladder 2. The ladder typically comprises an extension ladder, however the scope of the invention comprises inclusion of the ladder safety device 1 with any ladder, such as but not limited to a step ladder, an extension ladder, a scaffold and ladder combination, and combinations thereof. The invention will be described with reference to an extension ladder 2 (hereinafter "ladder"), however this description is merely exemplary, and is not meant to limit the invention in any way.

The ladder 2 comprises side rails 3, typically two side rails, and a plurality of rungs 4. The rungs 4 of the ladder 2 are disposed between the side rails 3 in a typical ladder construction. The rungs 4 are connected to each side rail 3 so as to provide structural integrity to the ladder 2, as is known in the art. In other words, the rungs 4 keep the sides 3 of the ladder 2 from moving away from each other.

Figure 2:
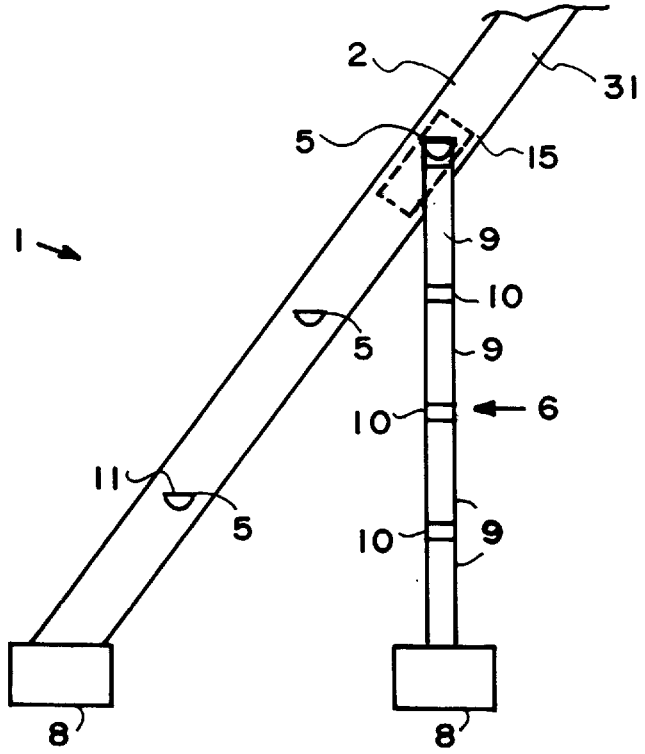
FIG. 2 is a side schematic view of a stabilizing, safety device for an extension ladder.

The rungs 4 define foot and hand holds for a person who will be climbing the ladder 2. The rungs 4 are typically provided in any appropriate configuration for ease of gripping by hand and standing upon with one's feet. Thus, each rung 4 can be configured with a round cross-section, an oval cross-section, other arcuate cross-section configuration, and with a generally flat upper surface 11 (FIGS. 1 and 2). The rung 4, in which the stabilizing, side safety supports 6 is provided (as described hereinafter) may be an existing rung 4 of the ladder 2. By providing the stabilizing, side safety supports 6 in an existing rung 4, the stability and structural integrity of the ladder safety device 1. Further, by providing the stabilizing, side safety supports 6 in an interior 5 of an existing rung 4, the ladder safety device 1 will comprise a relatively simple configuration.

In FIG. 1, the stabilizing, side safety supports 6 comprises a cross-sectional configuration that is provided in an interior 5 of the rung 4. The stabilizing, side safety supports 6 is provided with a similar cross-sectional configuration of the rung 4. The similar configurations provide enhanced stability and structural integrity as the fit of the rung 4 and stabilizing, side safety supports 6 is such that there is little play in the fits, and thus the enhanced stability and structural integrity.

In FIG. 2, locking structures 175 are provided in the stabilizing, side safety supports 6. The locking structures 175 comprise pins or similar locking members 176 that extend through apertures 177 in a plate 178. The locking members 176 extend into apertures 178 that align with the apertures 177. With the locking members 176 in place through the apertures 117 and 178, the stabilizing, side safety supports 6 will be locked in a position that substantially prevents movement of the stabilizing, side safety supports 6 with respect to the ladder 2.

Each rung 4 is normally provided with a hollow interior 5, which often is exposed and open on outside surfaces 31 of each side rail 3. The stabilizing, side safety supports 6 will be inserted into a rung 4 when in its stored position. The size and shape, such as the cross-sectional size and shape of the stabilizing, side safety supports 6 are generally complementary to the size and shape of the cross-sections of the rungs 4, so the stabilizing, side safety supports 6 can fit into the rungs 4 in its stored position.

The stabilizing, side safety supports 6 are attached to at least one rung 4 of the ladder 2 to define a structurally integral element of the ladder safety device 1. The ladder safety device 1 generally comprises two stabilizing, side safety supports 6. Each stabilizing, side safety support 6 is extendible from a rung 4 at the outside surfaces 31 of the side rails 3. Each stabilizing, side safety support 6 is attached to the ladder 2 by a joint 7. The joint 7 comprises a joint structure that permits pivoting of the stabilizing, side safety supports 6 for permitting variance of an angle $\alpha$, which is the angle defined between the side rail 3 and the stabilizing, side safety support 6 in its extended, stabilizing position (to be described hereinafter), when engaged with the base G, such as the ground. The base G will hereinafter be referred to as "ground" G.

The ladder safety device 1 typically comprises two stabilizing, side safety supports 6, so that two angles $\alpha$ are defined for each ladder 2. The angles a of each stabilizing, side safety supports 6 on a ladder 2 may be equal or unequal depending the orientation of the ladder 2 and the positioning of the ground G with respect to the ladder 2. The joint 7 permits movement of the stabilizing, side safety support 6 so the stabilizing, side safety supports 6 stabilize the ladder 2 when the ladder safety device 1 is in its extended, stabilizing position. The angle a varies dependent on the intended use of the stabilizing, side safety supports 6. For example, and in no way limiting of the invention, the angle $\alpha$ is in a range from about 0°, in which the stabilizing, side safety supports 6 are essentially parallel to the side rails 3 of the ladder 2, to about 90°, in which the stabilizing, side safety supports 6 are essentially orthogonal or perpendicular to the side rails 3 of the ladder 2. In an exemplary embodiment of the invention, the stabilizing, side safety supports 6 extend from a lower rung 4 f the ladder 2. In this embodiment, the stabilizing, side safety supports 6 widen the base of the ladder 2 and provide stabilizing for the ladder 2.

Figure 3:
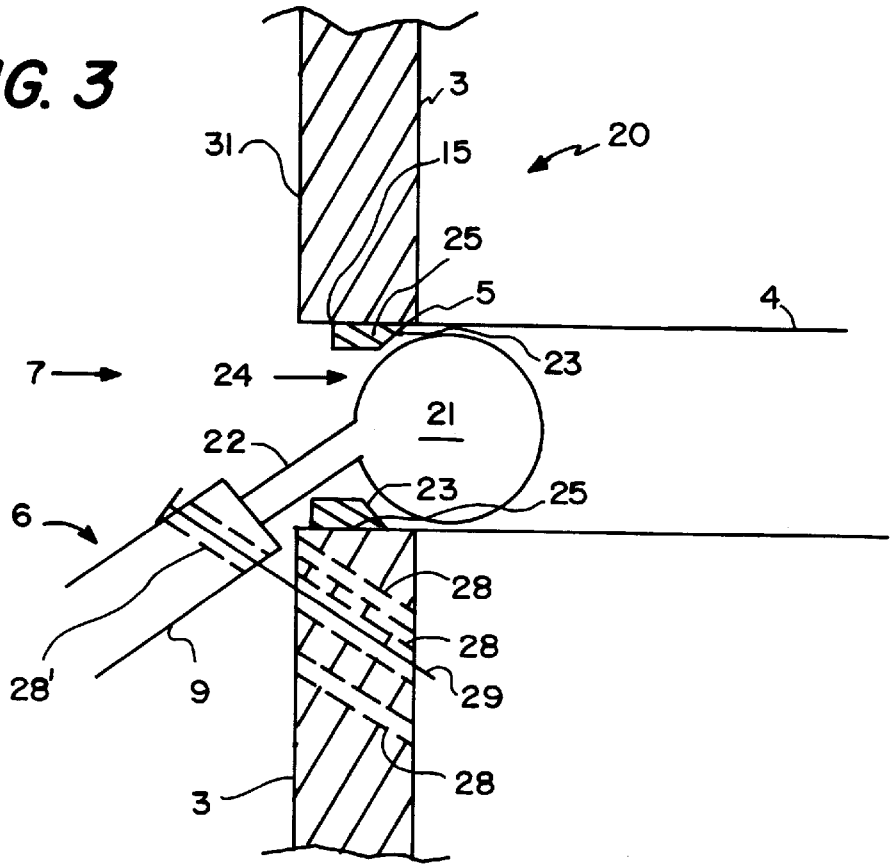
FIG. 3 is a detailed schematic view of an exemplary joint and stabilizing, safety device at a ladder rung for an extension ladder.

FIG. 3 illustrates is a close-up view of a joint 7. The joint 7 comprises any joint structure that permits variance of the angle $\alpha$, positioning of the stabilizing, side safety supports 6 to engage the ground G, and provide lateral stability of the stabilizing, side safety supports 6. For example, as illustrated in FIG. 1, the stabilizing, side safety supports 6 can be pivoted about an axis X of the rungs 4 essentially in a full circle of about 360°, as illustrated by the arrow 50 in FIG. 1. The joint 7, as illustrated in FIG. 3, comprises a ball-and-socket joint 20. The illustrated ball-and-socket joint 20 is merely exemplary of a joint structure, and other joint structures are within the scope of the invention.

In FIG. 3, the ball-and-socket joint 20 comprises a block 25 within a recess 15 in side rail 3. The block 25 defines a seat 23 that is disposed within the interior 5 of a rung 4. The seat 23 defines an opening 24 of a first size. The stabilizing, side safety supports 6 comprise a plurality of stabilizing, side safety support sections 9 (hereinafter referred to as "sections 9" and that will be described more detail hereinafter). The section 9 that is disposed closest to the side rails 3 of the ladder 2 is a "first section" and comprises a connection to the ball-and-socket joint 20. The connection to the ball-and-socket joint 20 typically comprises a ball 21 that is connected to the first section by a connector 22. The ball 21 is formed in a second size that is smaller than the first size. Therefore, the ball 21 will not be able to be withdrawn through the opening 24 from the block 25 through the seat 23. The stabilizing, side safety supports 6 will not be able to be withdrawn from the ladder safety device 1 and ladder 2, and the stabilizing, side safety supports 6 form an integral, one-piece, unitary unit. The ball 21 is freely capable of being slid in the rung and comprises a size and shape complementary to the size and shape of the rung 4. Further, the ball 21 can be coated in a self-lubricating coating to facilitate sliding of the ball 21 within the rung 4.

Each respective joint 7 can further comprise a lock structure to maintain the stabilizing, side safety supports 6 in its extended position. Thus, the joint 7 is not movable. In FIG. 3, the lock structure for a joint 7 comprises at least a plurality of bores 28 in the side rails 3 and bores 28' in one of the sections 9. The bores 28 and 28' are aligned when the stabilizing, side safety supports 6 stabilizing, side safety supports 6 have been pivoted to their extended position. A lock pin 29 is positionable in the bore or bores 28 and 28' to lock the joint 7 and stabilizing, side safety supports 6 in their extended position. The position of the bores 28 and 28' and pin 29 as illustrated are merely exemplary, and is not intended to limit the invention in any manner.

The sections 9 of the stabilizing, side safety supports 6 are interconnected and extendible from their stored position in the rungs 4 to their extended position. For example, each section 9 of a stabilizing, side safety supports 6 has a different diameter so as to fit inside one another, such as in a telescoping relationship. The lengths of each section of the stabilizing, side safety supports 6 can have any appropriate length depending on the intended use of the ladder safety device 1. The following description of the invention, as embodied by the invention, will refer to a telescoping relationship for the sections 9 of the stabilizing, side safety supports 6. This relationship is merely exemplary, and is not intended to limit the invention in any way.

Figure 3A:
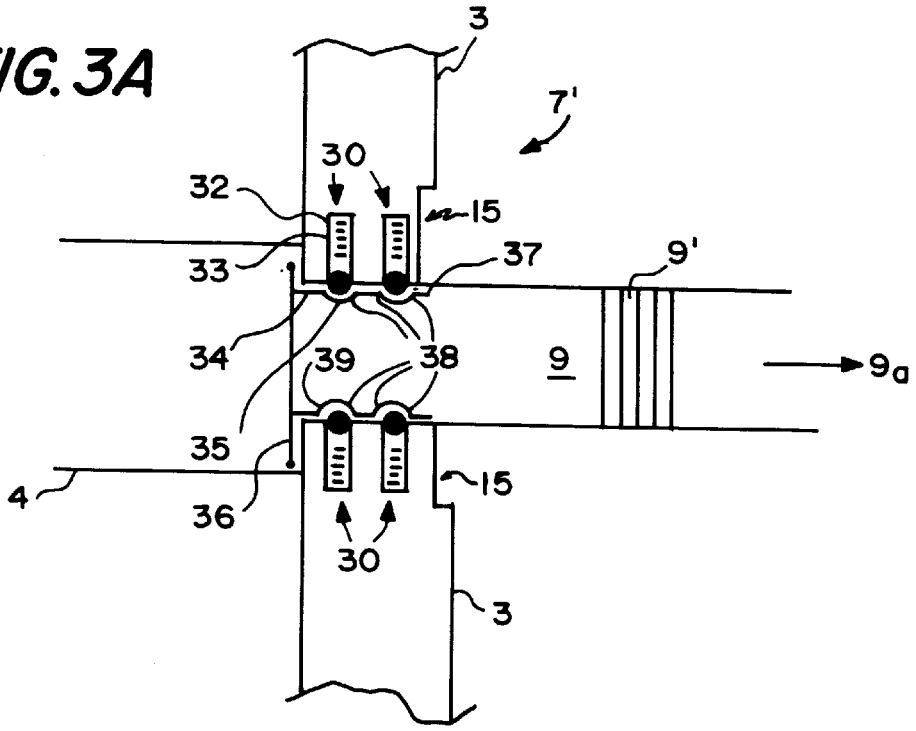
FIG. 3*a* is a detailed schematic view of another exemplary joint and stabilizing, safety device at a ladder rung for an extension ladder.

FIG. 3*a* illustrates a further structure for a joint 7' that permits extension of the stabilizing, side safety supports 6 from a rung 4 of the ladder safety device 1. The joint 7' comprises a bore detent assembly 30. The bore detent assembly 30 comprises at least one bore 32 that is positioned in the side rails 3 of a ladder 2. FIG. 3*a* illustrates opposed sets of two bores 32 each, however this structure of the joint 7' is merely exemplary, and is not intended to limit the invention in any manner. A spring 33 is positioned in each bore 32 so as to bias a locking ball 33 in a direction out of the bore 31. The last section 9 of the stabilizing, side safety supports 6 to be withdrawn from the rung 4 in the extended position of the stabilizing, side safety supports 6 comprises a plurality of detent recesses 35. Each detent recess 35 comprises a front slanting wall 38 that permits ingress and egress of the ball 34 from the recesses 35. The last recess 35 of the bore detent assembly 30 comprises a generally vertical wall 39 that prevents the ball 34 from being withdrawn from the recess 35. Therefore, the bore detent assembly 30 maintains the section 9 in a locking position to stabilize the ladder 2.

FIG. 3*a* illustrates opposed sets of two detents 35 each, however this structure of the joint 7' is merely exemplary, and is not intended to limit the invention in any manner. The number and positioning of the detents 35 are complementary to the number and positioning of the bore detent assemblies 30. Further, the last section 9 of the stabilizing, side safety supports 6 to be withdrawn from the rung 4 in the extended position of the stabilizing, side safety supports 6 can comprise an end plate 36. The end plate 36 is formed in a size that is larger that an opening 37 of the rung 4 at the side rails 3. Thus, the last section 9 of the stabilizing, side safety support 6 cannot be extended out of the rung 4 because the end plate 36 will contact the side rail 3 at the opening 37, and further extension of the section 9 will not be possible. Furthermore, in the following description, the bores 32 of the bore detent assembly 30 may be provided on one of the side rails 3 of the ladder 2 and last section 9 and the recesses 35 can be positioned in the other of the of the side rails 3 of the ladder 2 and last section 9. With the configuration of the joint 7', the section 9 can comprise a flexible joint 9', which permits pivoting and positioning of the stabilizing, side safety supports 6 with the base G so as to both laterally and backwardly stabilize the ladder 2.

In operation, the last section 9 of the 32 is extended from the rung 4 with the spring biased balls 34 being biased out of the bore 33. The extension of the last section 9 continues until the spring biased balls 34 are forced into a recess 35 at which time the balls 34 are locked in the recesses 35. Further withdrawal and extension of the stabilizing, side safety supports 6 is prevented by the wall 39 of the recess being essentially vertical and preventing further movement of the section 9 in the direction 9*a*.

FIG. 3 illustrates a further structure for a joint 7" that permits extension of the stabilizing, side safety supports 6 from a rung 4 of the ladder safety device 1. The joint 7" comprises a bore detent assembly 30 and ball and socket joint 20. Each of the bore detent assembly 30 and ball and socket joint 20 are as discussed above, and a further explanation of these features is omitted. The ball and socket joint 20 is optional and need not be provided in this embodiment. The combination of the bore detent assembly 30 and ball and socket joint 20 in the joint 7" further includes an extension cylinder axle 5*a* of an stabilizing, side safety supports 6 that is retractable in the interior 5 of the rung 4. Thus, in accordance with this embodiment of the invention, the stabilizing, side safety supports 6 are withdrawn from the rung 4 and the bore detent assembly 30 locks the ladder safety device 1 in an extended position out of the rung 4. The ball and socket joint 20 will then be an extended, secured, and locked position that permits the ladder safety device 1 to stabilize the ladder 2.

A further embodiment of a structure for a joint 7*a*' is illustrated in FIG. 3. The joint 7*a*' permits extension of the stabilizing, side safety supports 6 from a rung 4 of the ladder safety device 1, as with the other joints described above. The joint 7*a*' comprises a bore detent assembly 30 and ball and socket joint 20. In this embodiment, the all and socket joint 20 is capable of being inserted into the rung 4 of a ladder 2 in the stored position of the stabilizing, side safety supports 6. The axle 5*a* of the joint 7*a*' includes the bore detent assembly 30, so as the joint 7*a*' is extended from the rung 4 the bore detent assembly 30 locks the joint 7*a*' and the stabilizing, side safety supports 6 in an extended position to stabilize the ladder 2.

Figure 4:
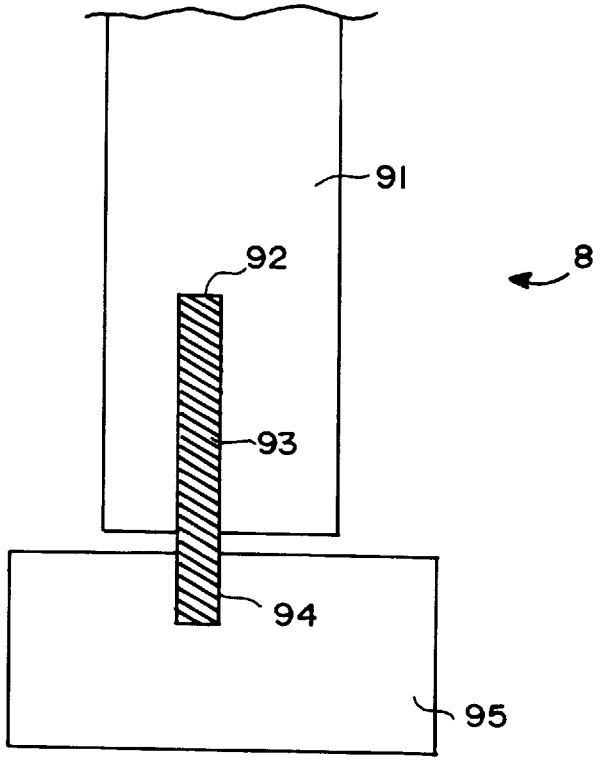
FIG. 4 is a schematic view of an exemplary stabilizing leveler, as embodied by the invention.

A recess 15 in the side rails 3 is sized to receive each stabilizing levelers 8 when the stabilizing, side safety supports 6 are in their stored position inside the rungs 4. A stabilizing leveler 8 of the stabilizing, side safety supports 6 is disposed on a last section 91 of the stabilizing, side safety supports 6, which engages the ground G. The stabilizing leveler 8 can add to or decrease the overall length of each stabilizing, side safety support 6. For example, the stabilizing leveler 8 can comprise any known stabilizing leveler, such as but not limited to a block of material that is screw threaded, as illustrated in FIG. 4. In FIG. 4, a stabilizing leveler 8 is schematically illustrated in an exemplary non-limiting form. The illustrated exemplary stabilizing leveler 8 comprises a threaded bore 92 in the last section 91 of a stabilizing, side safety support 6. A threaded connector 93 is fit into the threaded bore 92. The depth of insertion of the threaded connection into the threaded bore 92 can be varied so as to vary its extension from the last section 91. The threaded connector 93 can be fit into a threaded bore 94 in a stabilizing base 95. The threaded connector 93 can be connected into the threaded bore 94 to vary the depth of insertion and the overall length of extension of the stabilizing leveler 8. Thus, the stabilizing leveler 8 can adjust the length of the stabilizing, side safety supports 6 in which it can engage the ground G, such as irregular or unlevel ground G, and stabilize the ladder 2.

Figure 5:
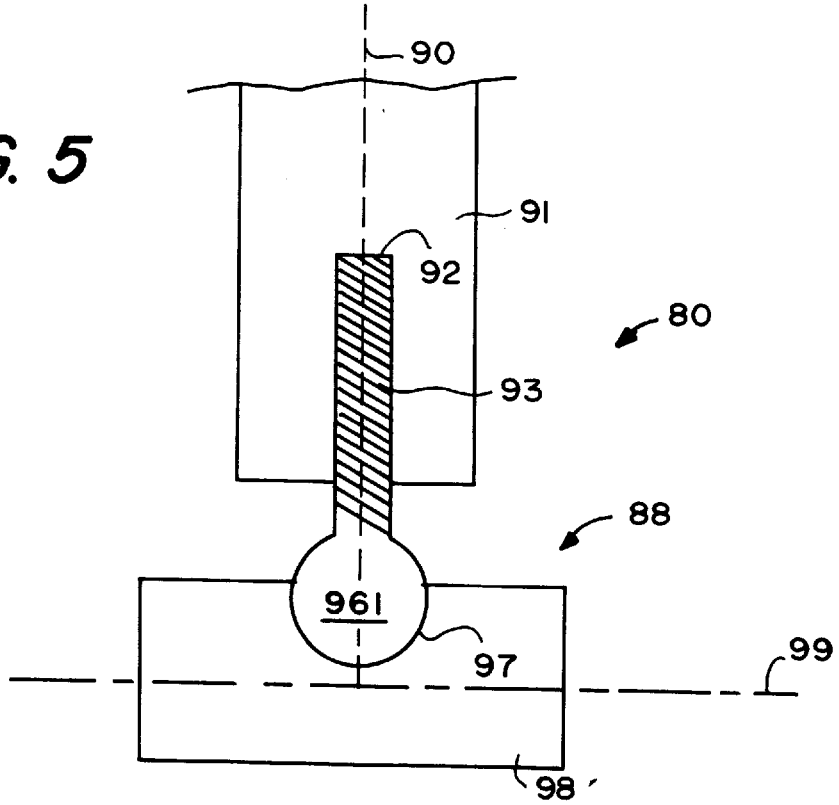
FIG. 5 is a schematic view of another exemplary stabilizing leveler, as embodied by the invention.

Alternatively, the stabilizing leveler 80 can comprise a ball and socket assembly 88 with a stabilizing base 98 as illustrated in FIG. 5. In the stabilizing leveler 80, as illustrated in FIG. 5, the stabilizing base 98 comprises a longitudinal axis 99 that is movable with respect longitudinal axis 90 of the last section 91. As illustrated in FIG. 5, the stabilizing leveler 80 comprises a threaded bore 92 in a last, terminating, most-remote section 91 of a stabilizing, side safety support 6. A threaded connector 93 is fit into the threaded bore 92 and its depth of insertion into the threaded bore 92 can be varied to change its length of extension from the last section 91. The end of the threaded connector 93, which is remote from the last section 91, comprises a ball 96 of the ball and socket assembly 88. The ball 96 is inserted into a socket 97 of the stabilizing base 98 in a non-removable fit, so the stabilizing base 98 is pivotable about the ball and socket assembly 88. Thus, the stabilizing leveler 80 can move to engage ground G that may be irregular and unleveled to stabilize the ladder 2. The stabilizing levelers 8 of the stabilizing, side safety supports 6 can also comprise a ground engaging assembly, which will be described with reference to FIG. 15 et seq. The exact nature of the stabilizing levelers 8 is dependent on the intended use of the ladder 2, and further is dependent on the nature of the surface upon which the ladder 2 is placed. For example, ground engaging stabilizers, as discussed hereinafter, are suitable for outside use for stabilizing the ladder 2 on soil, while if the ladder 2 is to be stabilized on a hard non-penetrable surface, such as concrete, stabilizers as discussed in FIGS. 4 and 5 are usable.

The stabilizing, side safety supports 6 may be positioned in any rung 4 of the ladder 2. The length, shape, configuration, and characteristics of the stabilizing, side safety supports 6 will vary depending on the location of the rung 4 on the ladder 2. For example, if the stabilizing, side safety supports 6 are located on a first rung 40 (FIG. 1), the stabilizing, side safety supports 6 may comprise only one section 9 that can be extended from the rung 40. If the stabilizing, side safety supports 6 are extendible from other rungs 4 of the ladder 2, the stabilizing, side safety supports 6 may comprise a plurality of sections 9. Accordingly, the lengths of the sections 9 can vary in length depending on the intended use of the ladder safety device 1 and are fit in the interior of the rung 4. Also, the scope of the invention comprises positioning of the stabilizing, side safety supports 6 may be in different rungs 4 of a ladder 2. For example, one stabilizing, side safety supports 6 may be positioned in one rung and another stabilizing, side safety support 6 can be positioned in another rung of the ladder. Further, the illustrated configuration of the ladder safety device 1, in which the stabilizing, side safety supports 6 extend from one rung 4, is also within the scope of the invention.

The lengths of one or all of the sections 9 of the stabilizing, side safety supports 6 may vary. One or all of the sections 9 can be changed by a user of the ladder safety device 1 to change the total length of the stabilizing, side safety supports 6. The total length of the stabilizing, side safety supports 6 can be changed for any reason, such as to adequately engage ground G that supports the ladder 2.

Each section 9 of the stabilizing, side safety supports 6 is lockable with each other by a locking device 10. The locking device 10 in its locked position comprises structure that prevents relative movement of the sections 9 with respect to each other when the stabilizing, side safety supports 6 is in an extended position for supporting and stabilizing the ladder 2. The locking device 10 in its unlocked position permits movement of the sections 9 of the stabilizing, side safety supports 6 to move the sections 9 of the stabilizing, side safety supports 6 into a rung 4 in its stored position.

The locking device 10 of the stabilizing, side safety supports 6 comprises an assembly that is easily operated by a user to permit locking and unlocking of the stabilizing, side safety supports 6. Therefore, extension, retraction and movement of the stabilizing, side safety supports 6 into a rung 4 is possible. Examples of some locking device 10 assemblies within the scope of the invention will now be discussed with respect to FIGS. 6–12. These examples are merely exemplary of the locking devices within the scope of the invention, and are not intended to limit the invention in any manner.

Figure 6:
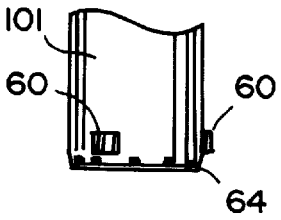
FIG. 6 is a sectional view illustrating a bayonet-type locking device, as embodied by the invention.
Figure 7:
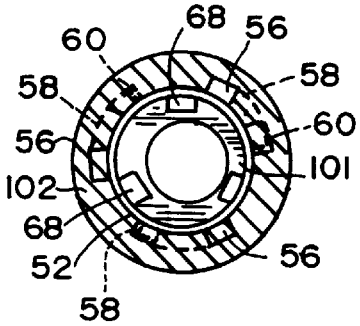
FIG. 7 is a side, sectional view taken on line 7—7 of FIG. 6.
Figure 8:
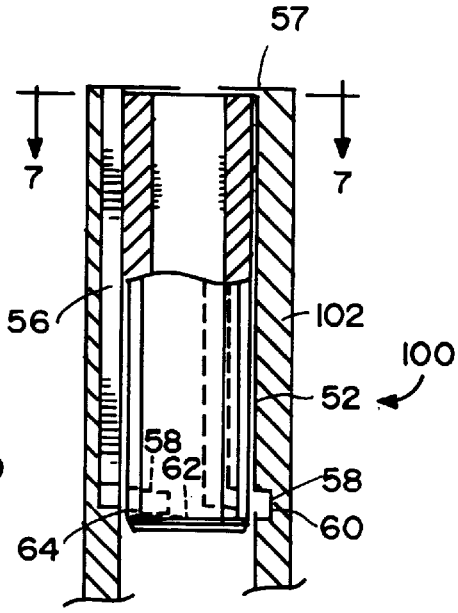
FIG. 8 is a side, sectional view of a lower end of the bayonet-type locking device, as embodied by the invention.

One exemplary locking device 10 that comprises a bayonet-type locking device 100 (hereinafter referred to as "bayonet-connection locking device"), as embodied by the invention, is illustrated in FIGS. 6–8. The bayonet-connection locking device 100 comprises at least one lug 60 that cooperates with at least one slot 58 on cooperating, adjacent first and second sections 101 and 102 of each stabilizing, side safety support 6. The bayonet-connection locking device 100 illustrated in FIGS. 6–8 shows lugs 60 on a first section 101 and slots on a cooperating, adjacent second section 102. The first section 101 is nested in the second section 102 in a telescoping nature. The scope of the invention includes lugs and slots on either of two cooperating, adjacent sections 101 and 102 of the stabilizing, side safety supports 6. Accordingly, as embodied by the invention, the structure and features disposed on one section 101 may be disposed on the other section 102 and the structure and features disposed on the section 102 may be disposed on the section 101, and the discussion of features of each section may apply to the other section.

The cooperating, adjacent section, section 101 is secured in a bore 52 of the other section 102 by the bayonet connection 100. The section 101 comprises a step 55 in a first diameter that separates a larger diameter portion of the bore 52 from a lower portion of the bore 52. The larger diameter of the bore 52 comprises a series of spaced, parallel grooves or bayonet channels 56 that extend along the length of the bore 52 from an upper end 57 of the section 102. The section 101 may comprise cooperating, similarly shaped structure to the spaced, parallel grooves or bayonet channels 56 to prevent undesired rotation of the sections 101 and 102. A downwardly inclined, transverse locking slot 58 extends in a generally circumferential direction from the lower end of each channel 56. The inclined, traverse locking slot 58 comprises a detent at its lowermost end. In FIGS. 6–8, three bayonet channels 56 are illustrated, however this is merely exemplary and not meant to limit the invention in any manner. The scope of the invention comprises a greater or lesser number of bayonet channels, if desired.

Section 101 comprises a plurality of spaced bayonet lugs 60 that project from its outer surface adjacent the lower end 62 of the section, for sliding engagement along the bayonet channels 56 as the section 101 is inserted into the bore 52 of section 102. The structure, as illustrated, shows three such lugs 60, however this is merely exemplary and not meant to limit the invention in any manner. The scope of the invention comprises a greater or lesser number of lugs, if desired.

Each lug 60 may comprise a slight incline or ramped lower surface. Once the lugs 60 enter the lower ends of the respective channels 56, the section is rotated in a clockwise direction. Therefore, the lugs 60 travel along transverse slots 58. Also, at the same time, the section 101 is urged axially downwardly, due to the incline of the slots 58 and the ramped lug surfaces. The section 101 is rotated until each lug reaches the detent at the lower end of each slot 58, releasably locking the insert in the bore 52.

Figure 9:
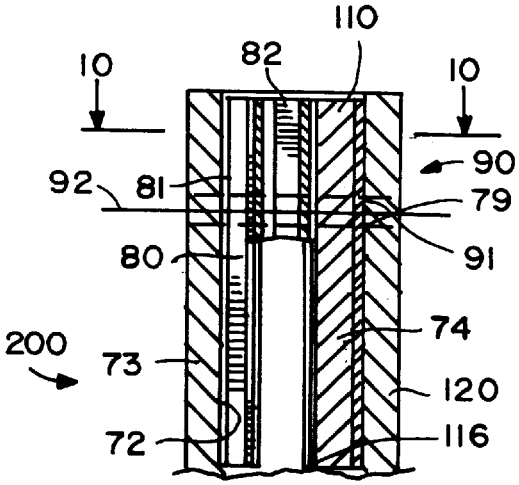
FIG. 9 is an expanding insert for a locking device, as embodied by the invention.
Figure 10:
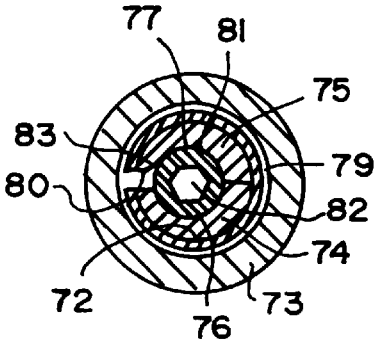
FIG. 10 is a sectional view taken on line 10—10 of FIG. 9, with the expanding insert in an unlocked position.
Figure 11:
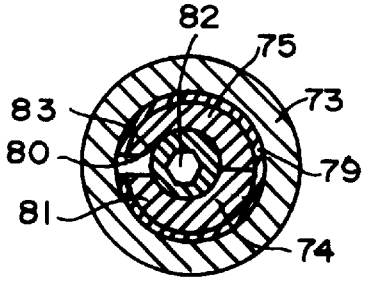
FIG. 11 is a view similar to FIG. 10, with the expanding insert in a locked position.

FIGS. 9–11 illustrate a further alternative locking device 200 for sections 9 of the stabilizing, side safety supports 6. The locking device 200 locks the sections 110 and 120 of the stabilizing, side safety supports 6 together. Section 110 of the locking assembly 200 is insertable into a bore 72 of a section member 120. Section 110, as embodied by the invention and illustrated in FIGS. 9–11, comprises two semi-cylindrical half members 74 and 75.

Each of the semi-cylindrical half members 74 and 75 comprise partially semi-circular recesses 76 and 77, which are disposed with respect to other at their mating flat faces. The semi-cylindrical half members 74 and 75 comprise at least partially semi-circular recesses 76 and 77 that together define a through-bore that extends through the section 110. The semi-cylindrical half members 74 and 75 may alternatively be held in a "C"-shaped metal sleeve or sheath 79. The sleeve 79 may be formed with differing wall thicknesses, so that the section 110 can be fit in different diameter bores 72.

One of the recesses 77 comprises an eccentric cut-out 80, which is illustrated in FIGS. 10 and 11. The eccentric cut-out 80 comprises screw threads (not illustrated for ease of understanding) that are in threaded engagement with a central actuating connector 81, such as a screw, (hereinafter referred to as "central actuating connector 81"). The central actuating connector 81 is attached to section 110 to be able to rotate therewith. The central actuating connector 81 comprises a projecting cam surface 83. The projecting cam surface 83 is located in the eccentric cut-out 80 when the central actuating connector screw 81 is in an inoperative position, as illustrated in FIG. 10.

To install and lock the section 110 into the section 120, section 110 is disposed in the bore 82 of section 120. The section 110 is then pushed in a direction that is generally axially downwardly into channel 72. The central actuating connector screw 81 is then rotated in a clockwise direction. The rotation causes the cam surface 83 to move out of cut out 80. The cam surface 83 then urges the semi-cylindrical half members 74 and 75 apart from each other. The semi-cylindrical half members 74 and 75 expand the effective diameter of the section 110, as illustrated in FIG. 11. The outer surface of the expanded sleeve 79 will then bear against the inner surface of bore 72. Frictional engagement between the two surfaces of the sections 110 and 120 will hold and lock the section 110 in the bore 72 of section 120.

As an alternative to the above-described locking device structure, a tapered screw may be used to expand the semi-cylindrical half members 74 and 75. Therefore, the tapered screw gradually increases diameter of the semi-cylindrical half members 74 and 75, and urges the two semi-cylindrical half members apart into a locking position.

Figure 12:
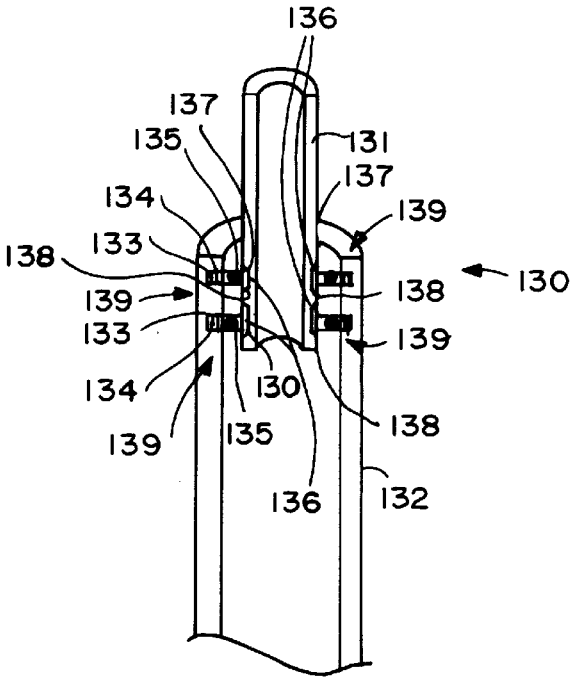
FIG. 12 is another locking device, as embodied by the invention.

FIG. 12 illustrates a further locking device structure 130. The locking device 130 comprises at least one spring-biased section locking detent assembly 139 to lock sections 131 and 132 of the stabilizing, side safety supports 200 in an extended, non-retractable position. Each spring-biased section locking detent assembly 139 comprises a bore 133 that is disposed one of the sections 131 and 132. In FIG. 12, the bore 133 is illustrated disposed in section 132 of the adjacent sections 131 and 132, however this positioning is merely exemplary. The bore 133 can be disposed in either of the sections 131 and 132 with the complementary detent recess structure being disposed in the other of the sections 131 and 132. A spring 134 is positioned in each bore 133 so as to bias a locking ball 135 out of the bore 133. The adjacent sections 131 of the stabilizing, side safety supports 6 comprises a plurality of detent recesses 136. FIG. 12 illustrates opposed sets of two detents recesses 136 each, however this structure is merely exemplary, and is not intended to limit the invention in any manner. The number and positioning of the detent recesses 135 are complementary to the number and positioning of the bore detent assemblies 139.

Each recess 136 comprises a front slanting wall 138 that permits ingress and egress of the ball 135 from the recesses 136. The last recess of the bore detent assembly 139 comprises a generally vertical wall 137 that prevents the ball 135 from being withdrawn from the recess 136. Therefore, the bore detent assembly 139 maintains the sections 131 and 132 of the stabilizing, side safety supports 6 in a locking position to stabilize the ladder 2.

Each of the above-described locking devices 10 may further comprise a locking pin assembly 90 that further supports and locks the sections 9 of the stabilizing, side safety supports 6 in an extended position. The locking pin assembly 90 of the locking device 200 is illustrated in FIG. 9 for ease of illustration, and although the locking pin assembly 90 can be used on all lock devices within the scope of the invention, and this illustration is not intended to limit the invention in any manner. The locking pin assembly 90 comprises locking mechanisms on adjacent sections of the plurality of sections. The locking pin assembly 90 comprises a through hole 91 (in phantom in FIG. 9) aligned in each adjacent section and a cooperating locking pin 92. The locking pin 92 extends through the through hole 91 to lock the adjacent sections with each other. The locking pin assembly 90 maintains the sections in a stable and extended position, and movement between adjacent sections is not possible with the locking pin 90 engaged.

Additional sections 9 of the stabilizing, side safety supports 6 can be added or removed as needed for changing the overall length of each stabilizing, side safety support 6. Thus, the stabilizing, side safety supports 6 extend from the ladder 2 and contact the ground G or other supporting surface. Sections 9 of a stabilizing, side safety support 6 may be removed to decrease the length of each stabilizing, side safety support 6, so a stabilizing, side safety support 6 extends from the ladder 2, can be pivoted, and can contact the ground G or other supporting surface.

Figure 13:
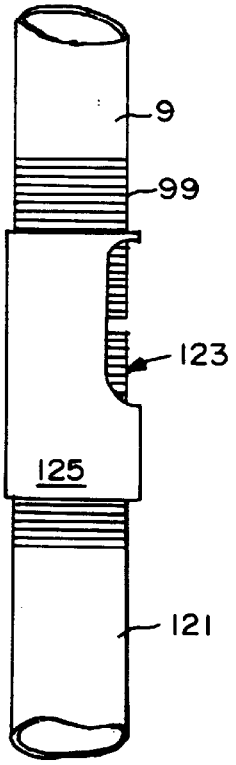
FIG. 13 is a side, part-sectional illustration of a connector that adds an additional section to stabilizing, side safety supports of the ladder safety device, as embodied by the invention.

The overall length of the stabilizing, side safety supports 6 may be adjusted by a user of the ladder safety device 1. The overall length of the stabilizing, side safety supports 6 may be decreased or increased by removing at least one section from or adding at least one section from the original sections 9 of the stabilizing, side safety supports 6, respectively. For example, as illustrated in FIG. 13, an additional section 121 may be added to the stabilizing, side safety supports 6 to any original section 9 of the stabilizing, side safety supports 6. The additional section 121 comprises threads 122 on an end 123 of the section 121. The original section 9 of the stabilizing, side safety support 6 comprises threads 99.

An additional section connector 125 connects the original section 9 to the additional section 121. The additional section connector 125 comprises connector threads on an internal surface wherein the additional section connector threads mate with the threads of the original section 9 and additional section 121. Therefore, the additional section 121 can be added to the stabilizing, side safety support 6. Depending on the length of the additional section connector 125 and the degree of mating for each of the additional section 121 and original section 9 into the additional section connector 125, the overall length of the stabilizing, side safety supports 6 may be varied by changing the degree of mating and threading into the additional section connector 125.

Figure 14:
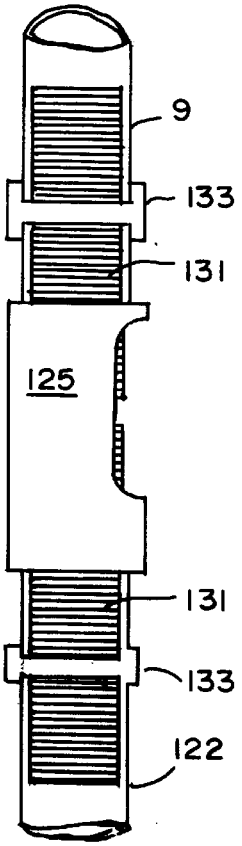
FIG. 14 is a side, part-sectional illustration of another connector that adds an additional section to stabilizing, side safety supports of the ladder safety device, as embodied by the invention.

FIG. 14 illustrates an alternative configuration for adjusting the overall length of the stabilizing, side safety supports 6. The structure of FIG. 14 is similar to that illustrated and described with respect to FIG. 13, and similar reference characters refer to similar elements. In FIG. 14, the original section 9 and the additional section 122 are each provided with a threaded insert 131. The additional section connector 125 is threadably mated to each threaded insert 131 so as to be added to an original section 9 of the stabilizing, side safety support 6. Depending on the length of the additional section connector 125 and the degree of mating of the threaded inserts 131 to the additional section connector 125, the overall length of the stabilizing, side safety supports 6 may be varied by changing the degree of mating and threading into the additional section connector 125. The threaded connector 131 can be connected to each respective section by a connector 133 of any appropriate configuration.

A general description of the operation of the ladder safety device 1 (FIGS. 1+) will now be described with reference to the figures. This description of the operation is merely exemplary, and is not meant to limit the invention in any manner. A user of the ladder safety device 1 will position the ladder 2 against a stationary object. The user positions the ladder 2 at the desired orientation on the stationary object ad ground G, and then uses the ladder safety device 1 to laterally stabilize the ladder 2. A user extends the stabilizing, side safety supports 6 from rungs 4 of the ladder 2 from its stored position, for example in a telescoping manner to an extended stabilized position.

The user first removes the stabilizing levelers 8 from the recesses 15 in the side rails 3. Each stabilizing, side safety support 6 is extended to its fully extended position. Each stabilizing, side safety support 6 is then pivoted about the joint 7, so the stabilizing leveler 8 engages the supporting surface G in its extended position. The locking devices 10 on each stabilizing, side safety support 6 are then moved into their locked position. Thus, each section 9 of the stabilizing, side safety support 6 is not moveable with respect to other sections 9 of the stabilizing, side safety support 6. Therefore, the stabilizing, side safety supports 6 of the ladder safety device 1 stabilizes the ladder 2, and the user may ascend the ladder 2 relatively certain that the ladder 2 is stabilized against lateral movement. Further, the locking pin 29 can be inserted into bores 28 in the joint 7 to lock the stabilizing, side safety supports 6 in their pivoted and locked position.

Figure 15:
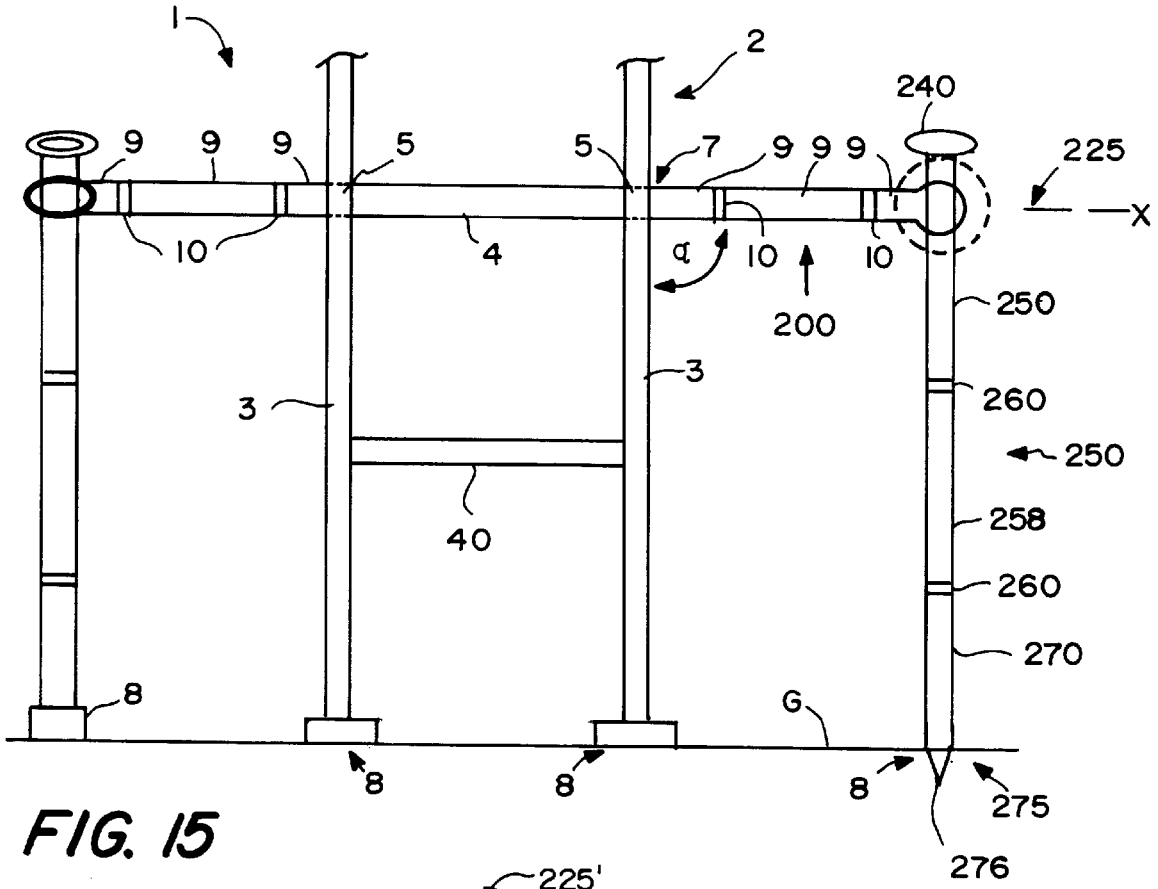
FIG. 15 is a side, part sectional illustration of a further ladder safety device with stabilizing, side safety supports, as embodied by the invention.

FIG. 15 is a side, part sectional illustration of a further ladder safety device 1 with further stabilizing, side safety supports 200, as embodied by the invention. In FIG. 15, like features of the ladder safety device 1, as described with respect to the above figures, are indicated with like reference characters. A further description of these features will be omitted for ease of description, however the interchangeably of the above features of the invention is applicable to the stabilizing, side safety supports 200.

In FIG. 15, the angle a of the sections 9 of stabilizing, side safety supports 200 to the side rails 3 is about 90°. In this orientation, the stabilizing, side safety supports 200 are essentially orthogonal or perpendicular to the side rails 3 of the ladder 2. The stabilizing, side safety supports 200 are extendible from a rung 4 of the ladder 2 generally co-linear to the axis x of the rung 4. The stabilizing, side safety supports 200 do not pivot, compared to the stabilizing, side safety supports 6 of the ladder safety device 1 in the figures discussed above. Accordingly, the sections 9 of the stabilizing, side safety supports 200 are locked by the locking devices 10 in an essentially parallel relationship to the base G.

The stabilizing, side safety supports 200 include a connection 225, which connects a generally vertical ground-engaging portion 250 to the sections 9 of the stabilizing, side safety supports 200. The vertical ground-engaging portion 250 includes a ground inserting anchoring assembly 275 that anchors the vertical ground-engaging portion 250 to the base G, for example the ground G.

Figure 16:
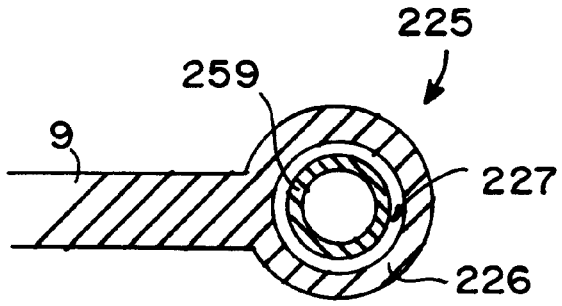
FIG. 16 is a sectional illustration of a connection for stabilizing, side safety supports, as embodied by the invention.

One configuration of the connection 225, as embodied by the invention, is illustrated in FIG. 16. The last section 9 of the stabilizing, side safety supports 200 for the connection 225 comprises a through-hole portion 226. The through-hole portion 226 can be formed integrally, in a one-piece manner with the section 9, and alternatively, the through-hole portion 226 can be a separate element that is connected to the section 9 by appropriate mechanical connectors (not illustrated herein). The connection 225 is extended with the sections 9 of the stabilizing, side safety supports 200, and stored within the rung 4 with the stabilizing, side safety supports 200.

The through-hole portion 226 as illustrated in FIG. 16 comprises a closed interior passage 227 that is formed with a size sufficient to permit sliding passage of vertical ground-engaging portion 250 therethrough. Therefore, the vertical ground-engaging portion 250 can be inserted in the through-hole portion 226 in its extended position (as described hereinafter) to engage the base G, and secure the ladder safety device 1. Accordingly, the ladder 2 will be stabilized by the stabilizing, side safety supports 200 to provide lateral stabilizing support and provides backward stabilizing for the ladder 2.

Figure 17:
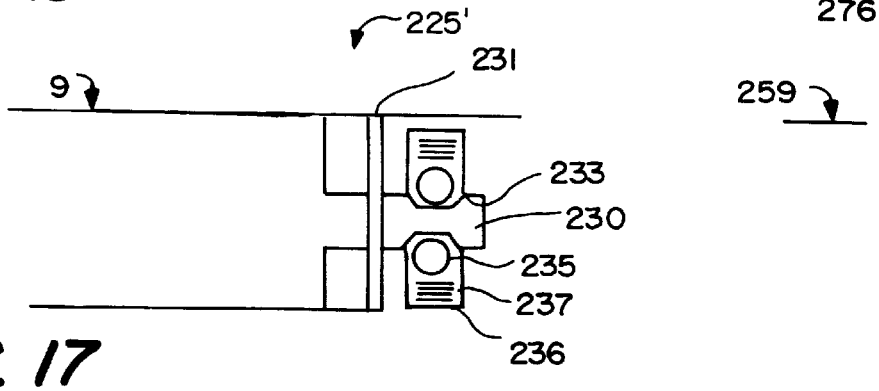
FIG. 17 is a sectional illustration of another connection for stabilizing, side safety supports, as embodied by the invention.
Figure 18:
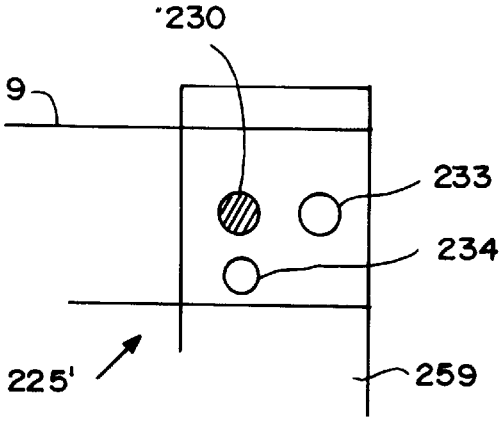
FIG. 18 is a sectional illustration of a connection for stabilizing, side safety supports, as embodied by the invention.

Alternatively, a connection 225' is configured so the vertical ground-engaging portion 250 is formed as a connected, one-piece unit to the stabilizing, side safety supports 200 and stored in and extendible from the rung 4. In this configuration, which is illustrated in FIG. 17, the connection 225' is formed as a pivoting, lockable connection 230. The pivoting, lockable connection 230 permits the vertical ground-engaging portion 250 to be extended from the rung 4 of the ladder 2 with the stabilizing, side safety supports 200, and thus be stored within a rung 4 of the ladder 2, in a similar manner as discussed with the above features The connector 225' comprises a pivoting lockable connection assembly that permits the vertical ground-engaging portion 250 to pivot from an essentially co-linear, straight-line orientation with the section 9 to an orientation that is generally perpendicular to the section 9 when the sections 9 are extended. As illustrated in FIGS. 17 and 18, the connector 225' comprises an extension 230. The extension 230 is generally a tabular extension comprising a reduced width and cross section compared to the width and cross-section of the section 9. The extension 230 is connected to a connected section 259 of the vertical ground-engaging portion 250 by a pivot pin 231. The dimensions of each section the vertical ground-engaging portion 250, including the connected section 259, intermediate section 258, and ground engaging section 270 (to be described in further detail hereinafter), and the sections 9 are sufficient to fit inside an interior 5 of a rung 4 in the stored position, as described above with respect to the earlier described features of the invention. The sections of the vertical ground-engaging portion 250, including the connected section 259, intermediate section 258, and ground engaging section 270 are connected to each other by locking devices 260. The scope of the invention includes the locking devices to be similar to the locking devices 10 described above.

The connector 225' also includes a spring-biased detent structure to lock the connected section in each of the essentially co-linear, straight-line orientation and the orientation that is generally perpendicular to the section 9 when the sections 9 are extended. The spring-biased detent structure comprises a plurality of detent recesses 233 and 234 in the extension 230. The detent recess 233 corresponds to the essentially co-linear, straight-line orientation of the connected section 259 to the section 9, and the detent recess 234 corresponds to the orientation of the connected section 259 that is generally perpendicular to the section 9 when the sections 9 are extended. Spring-biased locking balls 235 are placed in bores 236 in the connected section 259, and are biased into the recesses 233 and 234 by springs 237. Each recess 233 and 234 comprises slanting walls that permits ingress and egress of the ball 235 from the recesses 233 and 234. The figures illustrate two detent recesses, however this structure is merely exemplary, and is not intended to limit the invention in any manner. In the description of the invention, the recesses of the spring-biased detent structure may be provided on one of the connected section 259 and the section 9 while the spring-biased balls of the spring-biased detent structure can be provided on the other of the connected section 259 and the section 9.

In an exemplary description of the operation of the spring-biased detent structure, the connected section 259 is pivoted about the pin 231 from the extended, essentially co-linear, straight-line orientation of the connected section 259 with the section 9 to a generally perpendicular to the section 9 when the sections 9 are extended and the vertical ground-engaging portion 250 of the stabilizing, side safety supports 250 engage the base G. As the vertical ground-engaging portion 250 is pivoted, the spring biased balls 235 are biased out of the recess 233, and will enter the recess 234 when the vertical ground-engaging portion 250 is generally perpendicular to the section 9 to lock the vertical ground-engaging portion 250 in its extended position to stabilize the ladder safety device 1.

The stabilizing levelers 8, as illustrated in FIG. 15, comprise a ground engaging section 270. The ground engaging section 270 of the stabilizing leveler 8 can adjust the length of the stabilizing, side safety supports 200. The vertical ground-engaging portion 250 can engage the ground G, such as irregular or unlevel ground G, and stabilize the ladder 2. The stabilizing levelers 8 can comprise structures similar to those described above with respect to FIGS. 4 and 5. Alternatively, the stabilizing levelers 8 can comprise a ground insertion and engaging section structure comprising a ground engaging section 270 attached to the vertical ground-engaging portion 250.

The ground engaging section 270 includes a ground inserting anchoring assembly 275. Exemplary configurations of the ground inserting anchoring assembly 275 will now be described, however these configurations of the ground inserting anchoring assembly 275 are merely exemplary. Other configurations of the ground inserting anchoring assembly 275 are within the scope of the invention.

The ground inserting anchoring assembly 275 can comprise a spike-like or pointed element 276 (hereinafter referred to as "pointed element" 276), as illustrated in FIG. 15. The pointed element 276 can be pressed or forced into the base G, for example the ground. In FIG. 15, the vertical ground-engaging portion 250 comprises a flattened head 240 that a user of the ladder safety device 1 strikes to force the vertical ground-engaging portion 250 into the ground. For example, and not intended to limit the invention in any manner, if the ladder safety device 1 comprises a connection 225, a user of the ladder safety device 1 can strike the head 240 to force the vertical ground-engaging portion 250 into the ground. This feature is due to the ability of the connection 225 permitting the vertical ground-engaging portion 250 to freely move within the closed interior passage 227, which is formed with a size sufficient to permit sliding passage of vertical ground-engaging portion 250 therethrough. Therefore, the vertical ground-engaging portion 250 can be inserted in the through-hole portion 226 to engage the base G, and secure the ladder safety device 1. With a vertical ground-engaging portion 250 that uses a connection 225, as embodied by the invention, the vertical ground-engaging portion 250 is provided as a separate element from the stabilizing, side safety supports 200. The vertical ground-engaging portion 250 can be attached to a side rail 3 of the ladder 2 by connection means, such as bands, cords, ties, and other such connection means. Alternatively, the vertical ground-engaging portion 250 can be stored in other rungs of the ladder 2 that do not store the stabilizing, side safety supports. Accordingly, the vertical ground-engaging portion 250 will be present with the ladder safety device 1, so that ladder safety device 1 can be used as described herein to anchor prevent lateral skidding and backward skidding of the ladder 2 and to provide lateral and backward stabilizing of the ladder 2.

Alternatively, the ground inserting anchoring assembly 275 can comprise relative-movement structures that permit insertion of the ground inserting anchoring assembly 275 into the ground without requiring movement of the vertical ground-engaging portion 250. These relative-movement structures, as described hereinafter, are usable with either of the connection 225 or connection 225', as embodied by the invention. The following descriptions of the ground inserting anchoring assembly 275 can comprise relative-movement structures that permit insertion of the ground inserting anchoring assembly 275 into the ground without requiring movement of the vertical ground-engaging portion 250 are merely exemplary, and other such ground inserting anchoring assemblies 275 are within the scope of the invention.

Figure 19:
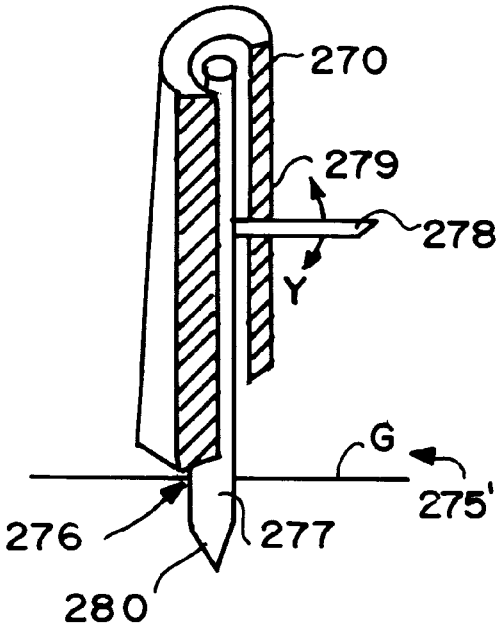
FIG. 19 is a sectional, schematic illustration of a ground inserting anchoring assembly, as embodied by the invention.

FIG. 19 illustrates one exemplary embodiment of a ground inserting anchoring assembly 275', as embodied by the invention. The ground inserting anchoring assemblies 275' comprises an extendible and retractable spike assembly 276 that is movable into and out of the ground engaging section 270 of the vertical ground-engaging portion 250. The extendible and retractable spike assembly 276 comprises an extendible and retractable spike element 277 and a plate 278, which is connected to the retractable spike element 277. The plate 278 can have a force applied to it to move a pointed end 280 of the extendible and retractable spike assembly 276 into the ground to anchor the ground inserting anchoring assembly 275' and prevent lateral skidding and backward skidding of the ladder 2 and to provide lateral and backward stabilizing of the ladder 2. The plate 278 can have a force applied to it to move a pointed end 280 of the extendible and retractable spike assembly 276 out of the ground to free the ladder 2 from its stabilized position. The plate 278 can be forced by a users foot or hand, and alternatively can be forced by a tool, such as a hammer. Further, the plate 278 can be pivoted about a hinge 279 to move the plate 278 in the direction of arrow Y to a stored position, where the plate 278 is in a position not to interfere with a user's movements and/or climbing of the ladder 2.

Figure 20:
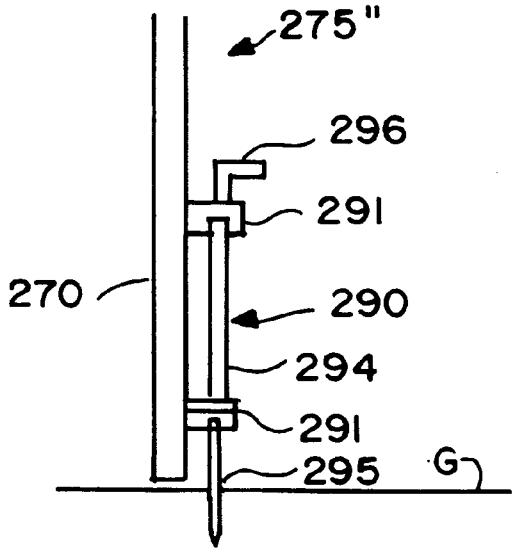
FIG. 20 is a sectional, schematic illustration of a further ground inserting anchoring assembly, as embodied by the invention.

A further exemplary configuration of a ground inserting anchoring assembly 275" is illustrated in FIG. 20. In FIG. 20, the ground inserting anchoring assembly 275" comprises a bracketed, ground inserting anchoring assembly 290. The bracketed, ground inserting anchoring assembly 290 comprises at least one bracket 291 through which a ground inserting device 294 with a pointed spike 295 is supported for reciprocating movement, as explained hereinafter. The bracketed, ground inserting anchoring assembly 290 comprises at least one bracket, however the scope of the invention comprises a plurality of brackets. FIG. 20 illustrates two brackets 291, however the scope of the invention includes a plurality of brackets, and any number of brackets are within the scope of the invention. The bracketed, ground inserting anchoring assembly 290 is attached to a side of the ground engaging section 270. In use, a handle 296 of the ground inserting device 294 is moved to force the pointed spike 295 of the ground inserting anchoring assembly 290 into the base G, for example the ground. The brackets 291 provide stabilizing and support for the movement of the ground inserting device of the ground inserting anchoring assembly 290 during its movement.

The materials of the ladder safety device 1 are materials that provide adequate structural strength thereto. For example, and in no way limiting of the invention, the material of various components of the ladder safety device 1 and its components include, but are not limited to, metals, alloys, plastics, composites, and combinations thereof.

The scope of the invention comprises interchangeable use of various described embodiments of the invention. For example, differing stabilizing levelers 8, as described herein, can be used separately or in combination with each other. The scope of the invention is not limited to the illustrated structures, and various features disclosed herein are useable with each other.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other components of the described and illustrated embodiments.

What is claimed:

1. A combination of a safety device for a ladder and a ladder, the ladder comprising side rails and a plurality of rungs interconnecting the side rails, the safety device comprising:

a plurality of stabilizing, side safety supports; the plurality of side safety supports being connected to the ladder in and at a rung of the ladder, each stabilizing, side safety support comprising an elongated member having a joint at one end thereof, and each elongated member and joint being connected to and stored in a stored position in one rung of the plurality of rungs, in which the one rung, in the stored position the entire length of the elongated member is substantially inserted within the one rung comprises a first periphery, the first periphery comprises a non-circular shaped periphery, a periphery of the elongated members comprising a second periphery, the first periphery being larger than the second periphery so that the stabilizing, side safety support can be stored in the one rung, the first periphery of the one rung comprising a shape that is complementary in shape to the second periphery to provide stability and structural integrity with the first and second peripheries permitting minimal of free play between the one rung and the plurality of stabilizing, side safety supports, the plurality of stabilizing, side safety supports being extendible from the stored position in the one rung to a stabilizing extended position in which the elongated members are entirely withdrawn from the one rung and each joint retains the respective elongated member in connection with the one rung, wherein the stabilizing, side safety supports are engageable with a supporting base surface, wherein the stabilizing, side safety supports provide lateral stabilizing support for the ladder when extended from its stored position in the one rung position.

2. A combination according to claim 1, each elongated member comprises a plurality of sections.

3. A combination according to claim 2, wherein the plurality of sections are in telescoping relationship with each other.

4. A combination according to claim 1, wherein each of the stabilizing, side safety supports defines a first angle with the side rails of the ladder; the stabilizing, side safety supports define a second angle with the supporting base for the ladder, the first angle in a range from about 15° to about 90° and the second angle comprising an angle about 90°, each stabilizing, side safety support is extended from a rung of the ladder and locked in a position with a first angle 90°, and the stabilizing, side safety support comprises a vertical ground-engaging portion connected to each stabilizing, side safety support by a connector.

5. A combination according to claim 1, further comprising at least one vertical ground-engaging portion connected to each stabilizing, side safety support.

6. A combination according to claim 5, wherein the vertical ground-engaging portion comprises a retractable spike assembly within the vertical ground-engaging portion, the retractable spike assembly being moved from a first non-ground engaging position to a second ground engaging position.

7. A combination according to claim 1, wherein each joint comprising by at least one bore detent assembly.

8. A combination according to claim 7, wherein the bore detent assembly comprises:

detent recesses in one of the rung of the ladder and the stabilizing, side safety support; and spring-biased locking balls in the other of the rung of the ladder and the stabilizing, side safety support, wherein the stabilizing, side safety support is extended from the rung of the ladder until the spring-biased balls of the bore detent assembly enter the detent recesses to lock the stabilizing, side safety support in the extended position.

9. A combination according to claim 1, wherein elongated member comprises a plurality of telescoping sections, the device further comprising at least one locking mechanism between adjacent sections of the plurality of sections, wherein the locking mechanism comprises a bayonet locking mechanism between adjacent sections, the bayonet locking mechanism comprises at least one channel and at least one slot on one of the adjacent sections, and at least one locking lug on the other of the adjacent sections, the at least one channel and the at least one slot being disposed generally orthogonal to each other, the at least one locking lug locking lug enters the at least one slot in a first direction and then enters the at least one slot in a second direction, the second direction being generally orthogonal to the first direction, to lock the adjacent sections with each other.

10. A combination according to claim 1, wherein elongated member comprises a plurality of telescoping sections, the device further comprising at least one locking mechanism between adjacent sections of the plurality of sections, wherein the locking device comprises an expandable outer sleeve on one adjacent section and internal actuating device on the other adjacent section, the internal actuating device biasing the sleeve outwardly into an expanded position in which the sleeve is in close frictional engagement with the one adjacent section to lock the adjacent sections with each other.

11. A combination according to claim 10, further comprising at least one bore in the joint and a lock pin that is capable of being inserted into the at least one bore to lock the stabilizing, side safety support in the extended position.

12. A combination according to claim 1, wherein elongated member comprises a plurality of telescoping sections, the device further comprising at least one locking mechanism between adjacent sections of the plurality of sections, wherein the locking device comprises a through bore in each adjacent section and a locking pin that extends through the through bore in each adjacent section to lock the adjacent sections with each other.

13. A combination according to claim 1, wherein elongated member comprises a plurality of telescoping sections, the device further comprising at least one locking mechanism between adjacent sections of the plurality of sections, wherein the locking mechanism comprises at least one spring-biased section locking detent assembly.

14. A combination according to claim 13, wherein the at least one spring-biased section locking detent assembly comprises:

detent recesses in one of the adjacent sections of the plurality of sections; and spring-biased locking balls in the other of the adjacent sections of the plurality of sections, wherein sections are extended from each other until the spring-biased balls of the one spring-biased section locking detent assembly enter the detent recesses to lock the adjacent sections in the extended position.

15. A combination according to claim 4, wherein the connector comprises a spring-biased pivoted detent connector so the vertical ground-engaging portion and the stabilizing, side safety support are integrally connected and insertable into the rung of the ladder in the stored position.

16. A combination of a safety device for a ladder and a ladder, the ladder comprising side rails and a plurality of rung interconnecting the side rails, the safety device comprising:

a plurality of stabilizing, side safety supports; the plurality of side safety supports being connected to the ladder at a rung of the ladder, each stabilizing side safety support being connected and being stored in a stored position in one rung of the plurality of rungs and extendible from the stored position in the one rung to a stabilizing extended position in which the stabilizing, side safety supports are engageable with a supporting base surface, wherein the stabilizing, side safety supports provide lateral stabilizing support for the ladder, the device further comprising a joint that connects each stabilizing, side safety support to the ladder, wherein the joint retains each side safety stabilizer in connection with the one rung wherein the joint comprises a ball and socket assembly, the ball and socket assembly comprising a ball on one of the one rung and stabilizing, side safety support and a socket on the other of the one rung and stabilizing, side safety support, wherein each stabilizing, side safety supports may be extended from the one rung until the ball engages the socket to stop the extension of the stabilizing, side safety supports from the one rung.

17. A combination according to claim 16, wherein the joint comprises a locking pin to maintain the stabilizing, side safety supports in the extended position and each stabilizing, side safety support comprises a plurality of telescoping sections.

18. A combination of a safety device for a ladder and a ladder, the ladder comprising side rails and a plurality of rungs interconnecting the side rails, the safety device comprising:

a plurality of stabilizing, side safety supports; the plurality of side safety supports being connected to the ladder at a rung of the ladder, each stabilizing, side safety support being connected and being stored in a stored position in one rung of the plurality of rungs and extendible from the stored position in the one rung to a stabilizing extended position in which the stabilizing, side safety supports are engageable with a supporting base surface wherein the stabilizing side safety supports provide lateral stabilizing support for the ladder, wherein each stabilizing, side safety support comprises a stabilizing device and the side rails of the ladder comprise at least one recess that is disposed at the rung from which the side safety support extends, wherein each stabilizing device of the side safety support is disposed within a recess when the side safety support stabilizer is in a stored position.

* * * * *